US008222825B2

(12) United States Patent
Kang et al.

(10) Patent No.: US 8,222,825 B2
(45) Date of Patent: Jul. 17, 2012

(54) DIMMER FOR A LIGHT EMITTING DEVICE

(75) Inventors: Hyun Gu Kang, Ansan-si (KR); Do Hyung Kim, Ansan-si (KR); Sang Min Lee, Ansan-si (KR); Yoon Seok Lee, Ansan-si (KR)

(73) Assignee: Seoul Semiconductor Co., Ltd., Seoul (KR)

( * ) Notice: Subject to any disclaimer, the term of this patent is extended or adjusted under 35 U.S.C. 154(b) by 163 days.

(21) Appl. No.: 12/844,238

(22) Filed: Jul. 27, 2010

(65) Prior Publication Data

US 2011/0181196 A1 Jul. 28, 2011

(30) Foreign Application Priority Data

| | | |
|---|---|---|
| Jul. 28, 2009 | (KR) | 10-2009-0068911 |
| Sep. 30, 2009 | (KR) | 10-2009-0093111 |
| Jun. 25, 2010 | (KR) | 10-2010-0060858 |
| Jun. 25, 2010 | (KR) | 10-2010-0060859 |

(51) Int. Cl.
*H05B 37/02* (2006.01)
*H05B 39/04* (2006.01)
*H05B 41/36* (2006.01)

(52) U.S. Cl. ..... 315/209 R; 315/246; 315/291; 315/307

(58) Field of Classification Search ..... None
See application file for complete search history.

(56) References Cited

U.S. PATENT DOCUMENTS

| | | | | |
|---|---|---|---|---|
| 8,106,596 | B2 * | 1/2012 | Chang et al. | 315/219 |
| 2006/0214603 | A1 * | 9/2006 | Oh et al. | 315/246 |
| 2008/0203936 | A1 * | 8/2008 | Mariyama et al. | 315/246 |
| 2009/0206776 | A1 * | 8/2009 | Inaba | 315/307 |

FOREIGN PATENT DOCUMENTS

| | | |
|---|---|---|
| JP | 2006-074879 | 3/2006 |
| KR | 10-2001-0079315 | 8/2001 |
| KR | 10-2006-0081902 | 7/2006 |
| KR | 10-0691188 | 3/2007 |

OTHER PUBLICATIONS

International Search Report of PCT/KR2010/004102 issued on Feb. 1, 2011.

* cited by examiner

*Primary Examiner* — Anh Tran
(74) *Attorney, Agent, or Firm* — H.C. Park & Associates, PLC

(57) ABSTRACT

Exemplary embodiments of the present invention relate to a dimmer for a light emitting device using an alternating (AC) voltage source. The dimmer includes a switch to be switched in response to a switching control signal and to deliver an AC voltage of an AC voltage source to the light emitting device, a current detector to detect an electric current to be provided to the light emitting device and to output a current detection signal, and a controller to output the switching control signal in response to a dimming control signal and the current detection signal.

18 Claims, 9 Drawing Sheets

DIMMER FOR A LIGHT EMITTING DEVICE

CROSS-REFERENCE TO RELATED APPLICATIONS

This application claims priority from and the benefit of Korean Patent Application No. 2009-0068911, filed on Jul. 28, 2009, Korean Patent Application No. 2009-0093111, filed on Sep. 30, 2009, Korean Patent Application No. 2010-0060858, filed on Jun. 25, 2010, and Korean Patent Application No. 2010-0060859, filed on Jun. 25, 2010, which are hereby incorporated by reference for all purposes as if fully set forth herein.

BACKGROUND OF THE INVENTION

1. Field of the Invention

Exemplary embodiments of the present invention relate to a dimmer for a light-emitting device and, more particularly, to a dimmer for a light emitting device, which provides a dimming function for a light emitting device by switching an alternating current (AC) input voltage at a high speed under pulse width modulation control to adjust the root-mean-square (RMS) value of the AC input voltage.

2. Discussion of the Background

In general, a lamp dimming function allows a user to control brightness of the lamp but may be restrictively used in practice. Currently, energy conservation has become an important concern in association with an increase in electrical energy consumption. Accordingly, the lamp dimming function has become a significant way to conserve energy rather than an optional function for user convenience. Further, a light-emitting diode (LED) has attracted attention as an environmentally friendly light source capable of improving energy conservation.

A conventional representative dimmer dims light from an AC LED by adjusting the root-mean-square (RMS) value (Vrms) of AC voltage by controlling the AC phase of the AC voltage using a semiconductor device, such as a triode for alternating current (Triac).

FIG. 1 is a block diagram of a conventional dimmer using a Triac. Referring to FIG. 1, the dimmer 10 includes a Triac switch 14 and an R/C (resistor/capacitor) phase controller 16. The Triac switch 14 supplies or blocks AC voltage from an AC voltage source 12 to a lamp, i.e. an AC LED 18. The R/C phase controller 16 includes a resistor R and a capacitor C to drive the Triac switch 14 by generating a phase control signal, that is, a gate turn-on signal, when an AC input voltage is 0 V. The phase control signal is an AC voltage signal delayed by a time constant determined by the resistor and capacitor of the R/C phase controller 16. The Triac switch 14 is turned on by the gate turn-on signal from the R/C phase controller 16 to allow the AC voltage to be supplied to the AC LED 18.

Thus, upper and lower dimming ranges of the Triac dimmer may be limited depending on the drive voltage of the Triac switch 14 and the operating characteristics of the resistor and capacitor of the R/C phase controller 16, thereby causing the AC LED to flicker. Further, in the Triac dimmer, the Triac switch 14 is abruptly switched by the gate turn-on signal output from the R/C phase controller 16, which may cause excessive generation of harmonics during the switching process.

In a phase control scheme of the Triac dimmer, the AC input voltage serves as a very important parameter in determining an output voltage and may not be a constant value in actual practice. A commercial AC power system creates various forms of loads, which may cause the system voltage to vary 10~20% depending on load conditions. Therefore, although the Triac dimmer has a fixed phase angle which determines the dimming range, an output voltage corresponding the AC voltage may vary at a constant ratio. Accordingly, the variation in output voltage may cause the AC LED to flicker.

Therefore, there is a need for a new type of drive circuit and control circuit for an AC voltage source in order to obtain a wider dimming range and a linear dimming function.

SUMMARY OF THE INVENTION

Exemplary embodiments of the present invention provide a dimmer for an AC light emitting device, which does not have a restricted dimming range depending on Triac drive voltage and operating characteristics of a resistor and a capacitor of an RIC phase controller.

Exemplary embodiments of the present invention also provide a dimmer for a light emitting device.

Additional features of the invention will be set forth in the description which follows, and in part will be apparent from the description, or may be learned by practice of the invention.

An exemplary embodiment of the present invention discloses a dimmer for a light emitting device which includes a switch to be switched in response to a switching control signal and to deliver an alternating current (AC) voltage of an AC voltage source to the light emitting device, a current detector to detect an electric current to be provided to the light emitting device and to output a current detection signal, and a controller to output the switching control signal in response to a dimming control signal and the current detection signal.

An exemplary embodiment of the present invention also discloses a dimmer for a light emitting device (LED) includes a rectifier to receive an alternating current (AC) voltage from an AC voltage source and to output a rectified voltage through full-wave rectification of the AC voltage, a switch to be switched in response to a switching control signal and to deliver the rectified voltage to the LED, a current detector to detect an electric current to be provided to the LED and to output a current detection signal, and a controller to output the switching control signal in response to a dimming control signal and the current detection signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
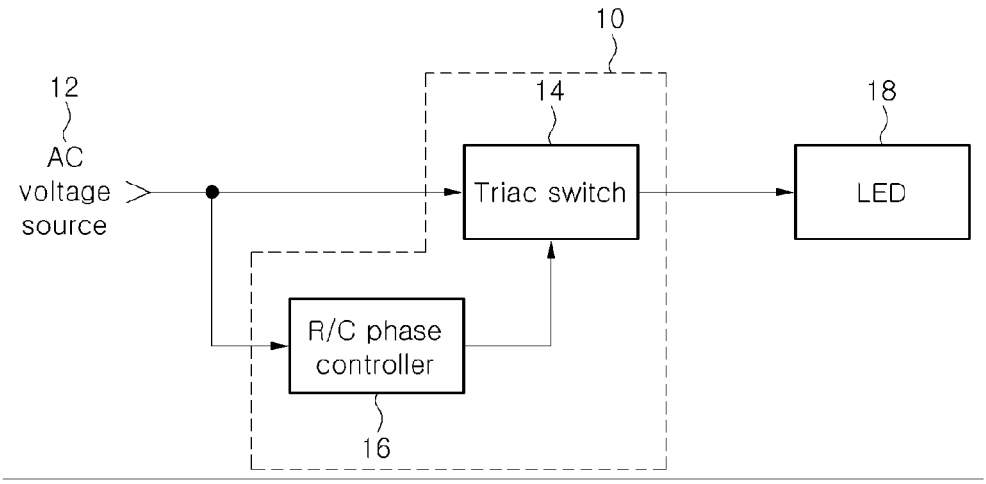
FIG. 1 is a block diagram of a conventional dimmer using a Triac.

The invention is described more fully hereinafter with reference to the accompanying drawings, in which exemplary embodiments of the invention are shown. This invention may, however, be embodied in many different forms and should not be construed as limited to the embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

Figure 2:
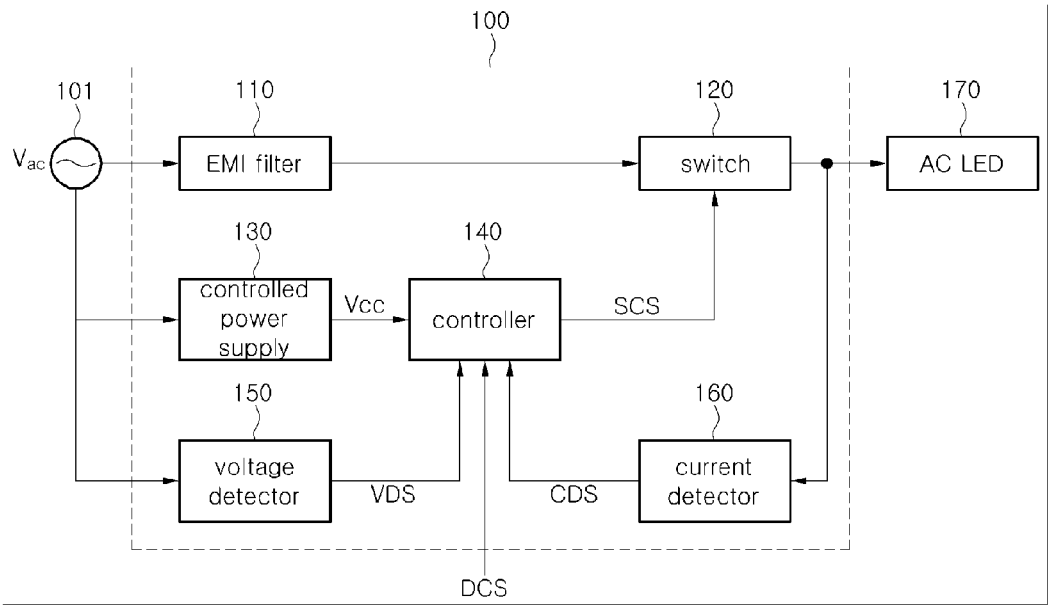
FIG. 2 is a block diagram of an AC LED dimmer according to an exemplary embodiment of the present invention.

FIG. 2 is a block diagram of an AC LED dimmer according to an exemplary embodiment of the present invention.

Referring to FIG. 2, an AC LED dimmer 100 includes an electromagnetic interference (EMI) filter 110, a switch 120, a controlled power supply 130, a controller 140, a voltage detector 150, and a current detector 160.

The EMI filter 110 eliminates electromagnetic interference included in an AC voltage of an AC voltage source 101. That is, the EMI filter 110 eliminates an impulse noise, harmonics or the like due to electromagnetic interference inside or outside the dimmer 100, which is produced in a power line between the AC voltage source 101 and an AC LED 170. The EMI filter 110 is optional, but is preferably included in the dimmer 100 to reduce the electromagnetic interference while improving a power factor.

The switch 120 is turned on/off in response to a switching control signal SCS from the controller 140 to selectively deliver a filtered AC voltage of the AC voltage source 101 to the AC LED 170.

The controlled power supply 130 performs rectification and voltage conversion functions. The controlled power supply 130 receives an AC voltage from the AC voltage source 101 and outputs a controlled voltage Vcc, generated by full wave rectifying the AC voltage into a DC voltage and voltage-dropping the DC voltage. Herein, the AC voltage is illustrated as being directly input from the AC voltage source 101 to the controlled power supply 130, but the present invention is not limited to this configuration and may be configured to allow the AC voltage to be input to the controlled power supply 130 through the EMI filter 110 to remove electromagnetic interference from the AC voltage of the AC voltage source 101.

The controller 140 outputs a switching control signal SCS in response to a dimming control signal DCS for controlling a dimming function for the AC LED 170 from an external device, a voltage detection signal VDS from the voltage detector 150, and a current detection signal CDS from the current detector 160.

The switching control signal SCS output from the controller 140 has a duty ratio corresponding to a difference between the dimming control signal DCS and each of the voltage detection signal VDS and the current detection signal CDS. Specifically, when the difference between the voltage detection signal VDS and the dimming control signal DCS has a positive value (+), the controller 140 reduces a pulse width of the switching control signal SCS by the corresponding difference, and also controls the pulse width of the switching control signal SCS according to the current detection signal CDS. On the other hand, when the difference between the voltage detection signal VDS and the dimming control signal DCS has a negative value (−), the controller 140 increases the pulse width of the switching control signal SCS by the corresponding difference, and also controls the pulse width of the switching control signal SCS according to the current detection signal CDS.

According to the exemplary embodiment, the controller 140 is not limited to this configuration and may generate a switching control signal SCS corresponding to a difference between one of the voltage detection signal VDS and the current detection signal CDS and the dimming control signal DCS. In other words, the controller 140 detects the voltage detection signal VDS and the current detection signal CDS to control a dimming level of the AC LED 170 corresponding to the dimming control signal DCS. For this purpose, the controller 140 may include a proportional integral (PI) analog control circuit. The controller 140 may be, for example, a programmable 8-bit microcontroller, which may allow interconnection to an external device (for example, a remote controller or home network system) while extending the operating range of the dimming system.

Further, the controller 140 receives a ramp signal to generate a switching control signal SCS having at least one pulse. The switching control signal SCS may be a square wave having a frequency of 20~100 kHz or more, and the pulse width modulation may be controlled in a range of 1~100%. The switching control signal SCS level may be varied depending on the magnitude of voltage, at which a transistor constituting the switch 120 can be turned on, and on the magnitude of voltage between a gate and a source of the transistor, at which the transistor of the switch 120 can be turned off. A variable resistor may be used to control the duty ratio of the switching control signal SCS. The variable resistor may be directly or indirectly coupled to a manipulator (not shown) for dimming the AC LED 170, and may be adjusted by the manipulator as needed, thereby enabling the dimming function for the AC LED 170. The controller 140 will be described in more detail with reference to FIGS. 8 and 11.

The voltage detector 150 detects the voltage of the AC voltage source 101 to output the voltage detection signal VDS. The voltage detection signal VDS is used to determine voltage fluctuation of the AC voltage source 101. Herein, the AC voltage Vac is illustrated as being directly input from the AC voltage source 101 to the voltage detector 150, but the present invention is not limited to this configuration and may be configured to allow the AC voltage Vac to be input to the voltage detector 150 through the EMI filter 110 to remove electromagnetic interference from the AC voltage Vac of the AC voltage source 101.

The current detector 160 detects electric current in the AC LED 170 to output the current detection signal CDS. The current detector 160 may be a resistor or a current sensor connected to the switch 120, and may detect electric current flowing from the switch 120 to the AC LED 170.

Figure 3:
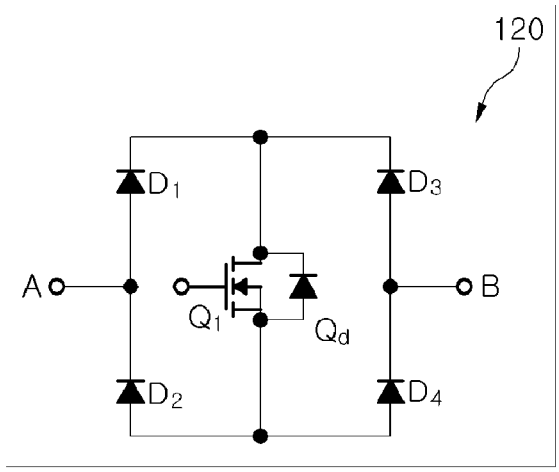
FIG. 3 is an exemplary circuit diagram of a switch of the AC LED dimmer according to an exemplary embodiment of the present invention.

FIG. 3 is a circuit diagram of the switch of the AC LED dimmer according to the exemplary embodiment.

Referring to FIG. 3, the switch 120 may a single phase bridge switch. The single phase bridge switch is a power circuit configured to have an AC chopper function capable of controlling AC voltage.

The switch 120 may include a switching transistor Q1, an overvoltage protection diode Qd, and first to fourth power diodes D1, D2, D3, and D4.

The switching transistor Q1 is connected to a cathode and an anode of the overvoltage protection diode Qd through a drain and a source thereof, respectively. The drain of the switching transistor Q1 is connected to a node between the first power diode D1 and the third power diode D3, and the source of the switching transistor Q1 is connected to a node between the second power diode D2 and the fourth power diode D4. A gate of the switching transistor Q1 receives the switching control signal SCS, that is, a pulse width modulation signal, applied from the controller 140. The switching control signal SCS acts as a gate turn-on signal. Accordingly, the switching transistor Q1 is turned on/off in response to the switching control signal SCS from the controller 140 to adjust electric current supplied to the AC LED 170, thereby performing the dimming function.

The overvoltage protection diode Qd serves to protect the switching transistor Q1 from overvoltage.

The power diodes D1, D2, D3, and D4 constitute a single-phase bridge circuit to allow the switching transistor Q1 to be always forwardly biased even when an AC voltage alternates between a positive voltage and a negative voltage.

In the switch 120 configured as above, the switching transistor Q1 is turned on/off in response to the switching control signal SCS sent from the controller 140 through the gate.

Since an on/off period of the switch 120 is included within the cycle of the pulse width modulation signal according to the duty ratio of the pulse width modulation signal output from the controller 140, the input voltage and current of the AC LED 170 change according to the pulse width modulation signal. Hence, an internal cycle in a period during which the input voltage of the AC LED 170 change according to the pulse width modulation signal and an internal cycle in a period during which the input current appears may be the same as the cycle of the pulse width modulation signal output from the controller 140.

Herein, an N-type MOSFET is used as the switching transistor Q1. However, the invention is not limited thereto and the switching transistor Q1 may be a P-type MOSFET. In addition, any type of switching transistor may be employed so long as it can be rapidly switched by the pulse width modulation signal to apply AC power to the AC LED 170.

The switch 120 may be operated in two different current paths. That is, when an AC voltage is applied with reference to Node A, the respective semiconductor diodes are forwardly biased in the sequence of D1→Q1→D4. When the AC voltage is applied with reference to Node B, the respective semiconductor diodes are forwardly biased in the sequence of D3→Q1→D2.

Thus, when the AC voltage is alternately applied in the directions of Node A (positive voltage with reference to an AC voltage source input) and Node B (negative voltage with reference to the AC voltage source input), the switching transistor Q1 is always forwardly biased.

Figure 4:
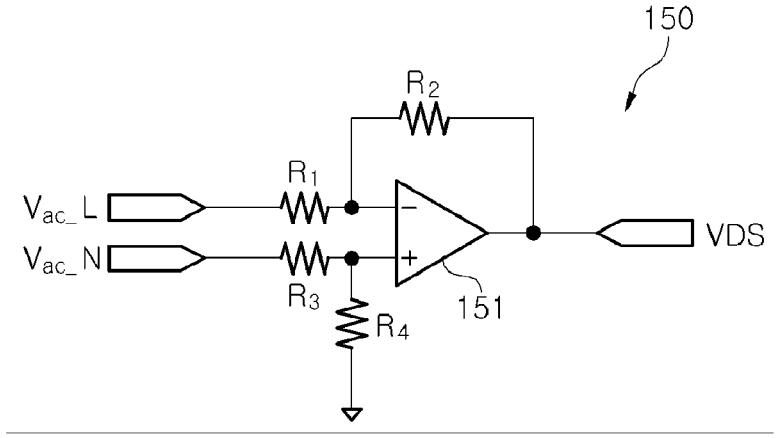
FIG. 4 is an exemplary circuit diagram of a voltage detector of the AC LED dimmer according to an exemplary embodiment of the present invention.
Figure 5:
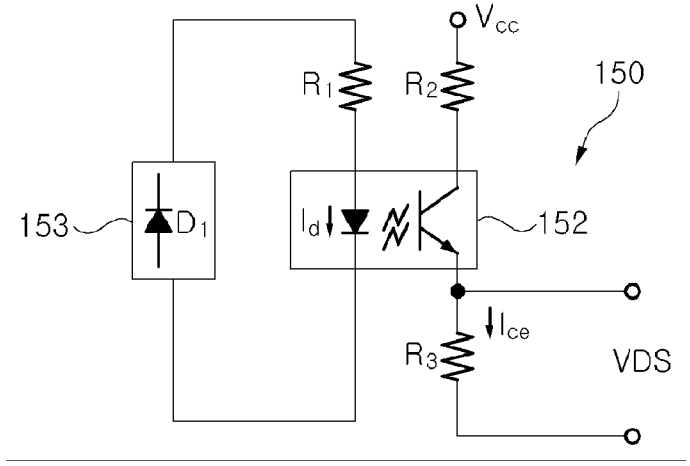
FIG. 5 is a circuit diagram of the voltage detector of the AC LED dimmer according to an exemplary embodiment of the present invention.

FIGS. 4 and 5 are circuit diagrams of the voltage detector 150 shown in FIG. 2 according to exemplary embodiments of the present invention.

Referring to FIG. 4, the voltage detector 150 may be a differential amplification circuit including an operational amplifier 151 for detecting AC voltage.

A first terminal Vac_L of the AC voltage source 101 is connected to an inverting terminal (−) of the operational amplifier 151 through a resistor R1, and a second terminal Vac_N of the AC voltage source 101 is connected to a non-inverting terminal (+) of the operational amplifier 151 through a resistor R3. Here, a gain of an output voltage is determined by a resistance ratio of a circuit constituted by the resistors R1 and R2, and a resistance ratio of a circuit constituted by resistors R3 and R4. In addition, the resistors R1 and R3 should have higher resistance than the resistors R2 and R4.

For example, when an AC voltage Vac of 220V is used, a difference of 220 V is maintained between an L-phase voltage input through the first terminal Vac_L of the AC voltage source 101 and an N-phase voltage input through the second terminal Vac_N of the AC voltage source 101. In this case, since the operational amplifier 151 adjusts the gain of the output voltage according to the resistance ratio of the resistors R1 and R2 and the resistance ratio of the resistors R3 and R4, for example, a voltage detection signal VDS of 1V may be output from the operational amplifier 151.

In a circuit set to normally operate at an AC voltage Vac of 220V, input of an AC voltage of 210V or 230V resulting from variation in the AC voltage source 101 causes the operational amplifier 151 to output a different signal from the voltage detection signal VDS of 1V. Accordingly, the voltage detection signal VDS is used to determine variation in voltage of the AC voltage source 101.

The voltage detector 150 supplies the voltage detection signal VDS to the controller 140, when the voltage detection signal VDS is output from the operational amplifier 151. The controller 140 generates a switching control signal SCS for controlling the switch 120 based on the voltage detection signal VDS from the voltage detector 150.

FIG. 5 is a circuit diagram of the voltage detector of the AC LED dimmer according to an exemplary embodiment.

Referring to FIG. 5, the voltage detector 150 shown in FIG. 2 may be a circuit, which includes a photo coupler 152 and a bridge rectifier (D1) 153 and is capable of detecting a bidirectional AC voltage by converting the AC voltage into a single phase DC voltage. Here, the voltage detector 150 may detect the magnitude of AC voltage by being electrically insulated from the AC voltage source 101 through the photo coupler 152.

In operation of the voltage detector 150, the bridge rectifier (D1) 153 converts a bidirectional AC voltage into a single phase DC voltage to supply a current Id to a primary diode of the photo coupler 152 through a resistor R1. Then, when a signal proportional to the current Id is applied to a base of a secondary diode of the photo coupler 152, a current Ice proportional to the current Id is supplied to a collector and an emitter of the secondary diode of the photo coupler 152. Here, resistors R2 and R3 determine the magnitudes of the current Ice and the signal. The resistor R2 represents an inverted output with respect to an input and the resistor R3 represents a non-inverted output with respect to the input. Thus, when the current Ice flows through the resistor R3, the voltage applied to the resistor R3 is delivered to the controller 140 as the voltage detection signal VDS of the AC voltage source 101.

Figure 6:
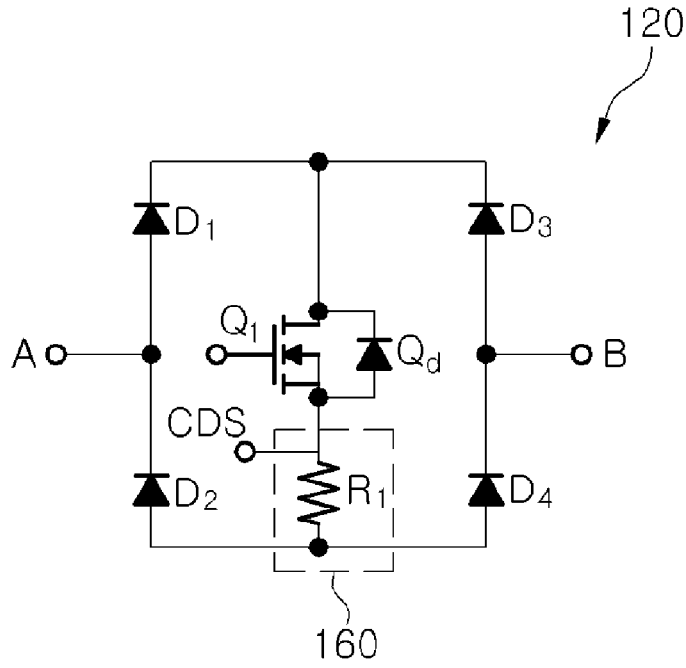
FIG. 6 is a circuit diagram illustrating detection of electric current output from the switch of the AC LED dimmer to an AC LED according to an exemplary embodiment of the present invention.
Figure 7:
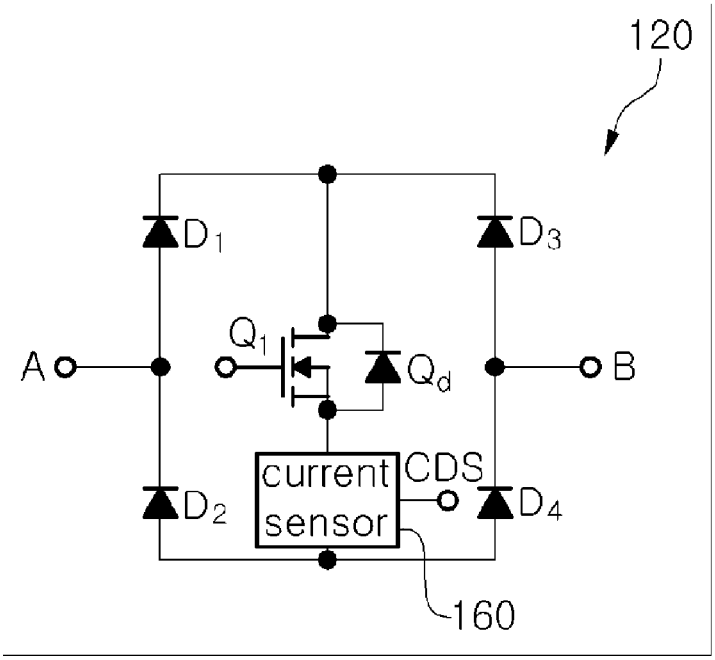
FIG. 7 is a circuit diagram illustrating detection of electric current flowing in the switch of the AC LED dimmer according to an exemplary embodiment of the present invention.

FIGS. 6 and 7 are circuit diagrams of the current detector 160 shown in FIG. 2 according to exemplary embodiments of the present invention. In FIGS. 6 and 7, the current detector 160 is operated when connected to the circuit of the switch 120.

Referring to FIG. 6, a current detector 160 according to an exemplary embodiment may include a resistor R1 and connected to the circuit of the switch 120 shown in FIG. 3 to detect a current flowing in the switch 120. That is, the current detector 160 of the exemplary embodiment may detect the current flowing through the resistor R1 to allow the current to be applied to the controller 140 by connecting one side of the resistor R1 constituting the current detector 160 to the source of the switching transistor Q1 of the switch 120 shown in FIG. 3 while connecting the one side of the resistor R1, which is connected to the source of the switching transistor Q1, to the controller 140.

In operation of the current detector 160, when an AC voltage is applied with reference to Node A, the current flows in the sequence of D1→Q1→R1→D4, and when the AC voltage is applied with reference to Node B, the current flows in the sequence of D3→Q1→R1→D2, as in the switch 120 shown in FIG. 3.

Thus, when the AC voltage is in bi-directions (positive direction and negative direction), the output current flowing through the switching transistor Q1 always flows in the forward direction in the resistor R1 constituting the current detector 160, and the current flowing through the resistor R1 is applied to the controller 140, so that the current detector may detect the current flowing in the switch.

Referring to FIG. 7, a current detector 160 according to an exemplary embodiment may be a current sensor connected to the circuit of the switch 120 in FIG. 3 to detect the current flowing through the switch 120. A current sensor may include a current transformer or RF transformer. That is, the current detector 160 of the exemplary embodiment may detect the current output from the switch 120 to the AC LED 170 by connecting one side of the current sensor constituting the current detector 160 to the source of the switching transistor Q1 of the switch 120 shown in FIG. 3. The current detected by the current sensor of the current detector 160 is supplied to the controller 140. The operation of the current detector according to the exemplary embodiment is the same as the exemplary embodiment shown in FIG. 6. The difference between two exemplary embodiments of the current detector 160 is that the circuit shown in FIG. 7 may detect a relatively high current of several dozen amperes using the current sensor including the current transformer or RF transformer. In the circuit of the exemplary embodiment shown in FIG. 6, since the resistor R1 used for current detection may cause power loss ($I_o^2$*R), it may be restrictively used in detection of a current of several amperes or more.

Figure 8:
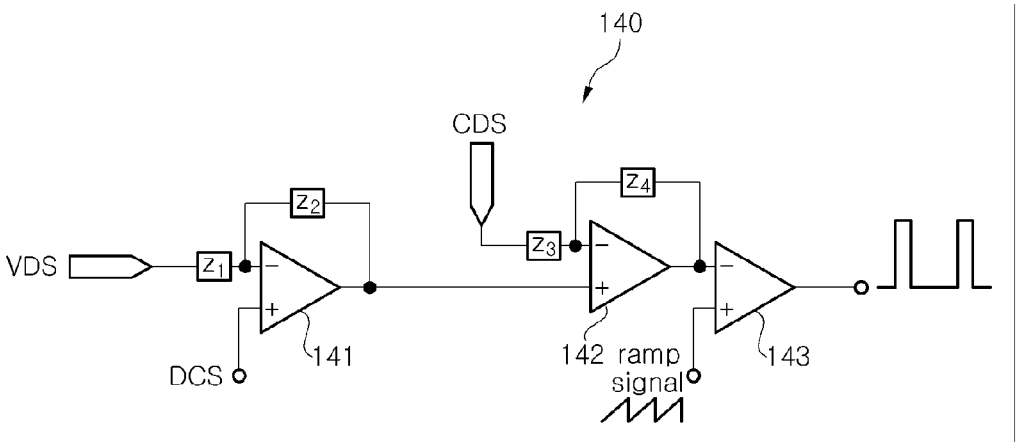
FIG. 8 is an exemplary circuit diagram of a controller of the AC LED dimmer according to an exemplary embodiment of the present invention.

FIG. 8 is a circuit diagram of the controller of the AC LED dimmer according to an exemplary embodiment of the present invention.

Referring to FIG. 8, the controller 140 may be an analog control circuit that controls both an average voltage and an average current using two parameters, that is, voltage and current. The controller 140 may include a first operational amplifier 141, a second operational amplifier 142, and a comparator 143.

A non-inverting terminal of the first operational amplifier 141 receives a dimming control signal DCS that is sent from an external device, for example a user's remote controller, and determines a dimming range. The dimming control signal DCS is used as reference signal Vref for outputting a difference between the dimming control signal DCS and the voltage detection signal VDS. An inverting terminal of the first operational amplifier 141 receives the voltage detection signal VDS detected by the voltage detector 150.

The first operational amplifier 141 outputs a difference between two values input to two input terminals of the first operational amplifier 141. Accordingly, the first operational amplifier 141 outputs the difference between the dimming control signal DCS sent from the external device and the voltage detection signal VDS detected by the voltage detector 150 using the dimming control signal DCS as a reference signal.

A non-inverting terminal of the second operational amplifier 142 receives an output from the first operational amplifier 141. An inverting terminal of the second operational amplifier 142 receives the current detection signal CDS detected by the current detector 160. Then, the second operational amplifier 142 outputs a difference between two values input to two input terminals of the second operational amplifier 142. Accordingly, the second operational amplifier 142 outputs the difference between the current detection signal CDS detected by the current detector 160 and the output from the first operational amplifier 141, which reflects the difference between the voltage detection signal VDS detected by the voltage detector 150 and the dimming control signal DCS sent from the remote controller.

The comparator 143 receives the output from the second operational amplifier 142 through an inverting terminal of the comparator 143 and a triangular wave (ramp signal) through a non-inverting terminal thereof. The triangular wave may be set to a suitable period and magnitude in order to control a pulse width modulation duty ratio corresponding to the output from the second operational amplifier 142. Accordingly, the comparator 143 outputs, based on the triangular wave (ramp signal), a pulse width modulation signal having a pulse width modulation duty ratio adjusted according to the output of the second operational amplifier 142.

As such, the controller 140 of FIG. 8 may be configured to output a first difference between the voltage detection signal VDS and the dimming control signal DCS, to output again a second difference between the current detection signal CDS and the first difference, and to generate and output, as a switching control signal SCS, a pulse width modulation signal having a pulse width modulation duty ratio adjusted according to the second difference. Hence, the current parameter is significant in relation to a control operation of the controller 140, so that the controller 140 may allow a more rapid and constant average current to be supplied to the AC LED 170. The first operational amplifier 141, second operational amplifier 142, and comparator 143 constituting the controller 140 may provide a proportional integral (PI) control analog circuit.

Next, operation of the AC LED dimmer of an exemplary embodiment will be described.

As shown in FIGS. 2 and 8, the controller 140 inputs a pulse width modulation signal to the gate of the switching transistor $Q_1$ of the switch 120 shown in FIG. 3 after generating the pulse width modulation signal based on signals detected by the voltage detector 150 and current detector 160 using a dimming control signal DCS input from an external device, to control a dimming function for the AC LED 170.

Thus, when the gate of the switching transistor $Q_1$ in the switch 120 is turned on, electric current flows from the drain of the switching transistor $Q_1$ to the source of the switching transistor $Q_1$, so that current is supplied to the AC LED 170, which may thereby emit light.

On the other hand, when the gate of the switching transistor $Q_1$ in the switch 120 is turned off, current cannot flow from the drain of the switching transistor $Q_1$ to the source of the switching transistor $Q_1$, so that current is not supplied to the AC LED 170. Thus, the AC LED 170 does not emit light.

The switching transistor $Q_1$ may operate in conjunction with the power diodes D1, D2, D3, and D4 of the switch 120. When an AC input voltage Vac is applied in a positive direction, the first and fourth power diodes D1 and D4 are forward biased to allow current to flow through the switching transistor $Q_1$. When the AC input voltage Vac is applied in a negative direction, the second and third power diodes D2 and D3 are forward biased to allow current to flow through the switching transistor $Q_1$.

Thus, the AC input voltage Vac and current may always flow from the drain of the switching transistor $Q_1$ to the source thereof. The power diodes D1, D2, D3, and D4 of the switch 120 determine the direction of the AC input voltage Vac and current while allowing the bidirectional AC current to be detected in a single phase shape.

Since an optical output of the AC LED 170 depends on the product of voltage and current, the peak value increases as the duty ratio of the pulse width modulation signal increases, so that the optical output of the AC LED 170 also increases as the duty ratio of the pulse width modulation signal increases.

The pulse width modulation signal may be linearly controlled by adjusting the duty ratio in a predetermined range, for example, from 1% to 100%.

The duty ratio may be adjusted by the dimming control signal sent from an external device, for example, a remote controller. The dimming control signal may be used as the reference signal Vref for adjusting the duty ratio.

Figure 9:
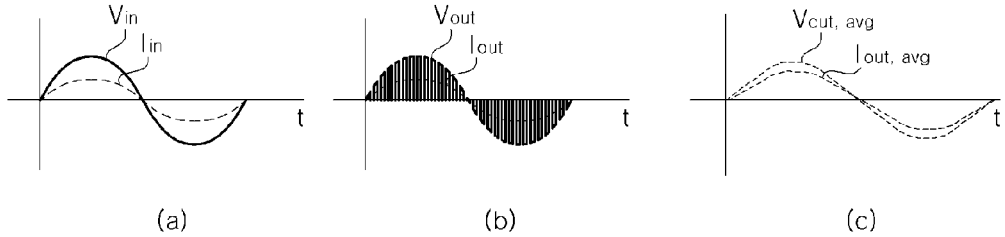
FIG. 9 is a waveform graph of input and output voltage and current in the AC LED dimmer according to an exemplary embodiment of the present invention.

FIG. 9 is a waveform graph of input and output voltage and current in the AC LED dimmer according to an exemplary embodiment of the present invention.

Referring to FIG. 9, (a) shows a waveform of AC input voltage and current, (b) shows a waveform of voltage and current supplied to the AC LED 170, and (c) shows a waveform of average voltage and current applied to the AC LED 170, which are realized through pulse width modulation in the AC LED dimmer of the exemplary embodiment.

In FIG. 9, the period of current in (c) showing the waveform of the average voltage and current to the AC LED is the same as a light emitting period of the AC LED 170.

Figure 10:
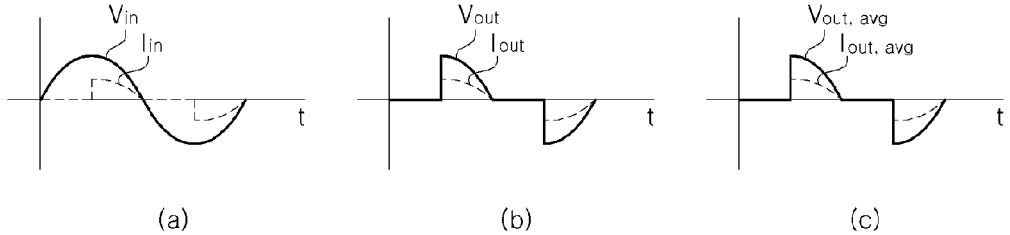
FIG. 10 is a waveform graph of input and output voltage and current in a general dimmer using a Triac.

FIG. 10 is a waveform graph of input and output voltage and current in a general dimmer using a Triac.

Referring to FIG. 10, (a) shows a waveform of AC input voltage and current, (b) shows a waveform of voltage and current supplied to an AC LED, and (c) shows a waveform of average voltage and current applied to the AC LED, which are realized in the AC LED dimmer using the Triac.

In FIG. 10, the period of current in (c) showing the waveform of the average voltage and current to the AC LED is the same as the light emitting period of the AC LED.

By comparing the light emitting periods of the AC LEDs shown in FIGS. 9 and 10 with reference to the current waveforms of (c), it can be ascertained that the pulse width modulation by the AC LED dimmer of the exemplary embodiment shown in FIG. 9 allows the AC LED 170 to emit light for a longer period than the dimmer shown in FIG. 10.

Accordingly, it can be ascertained that the average voltage or current control based on the pulse width modulation by the AC LED dimmer of an exemplary embodiment provides more stable optical output than the phase control of the dimmer using the Triac.

Figure 11:
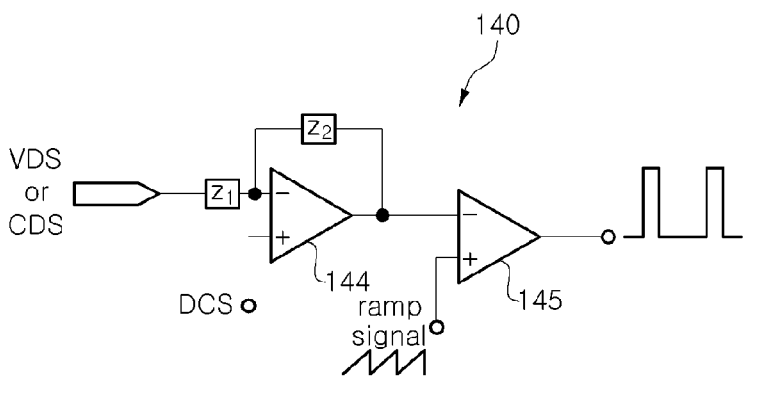
FIG. 11 is a circuit diagram of the controller of the AC LED dimmer according to an exemplary embodiment of the present invention.

FIG. 11 is a circuit diagram of the controller shown in FIG. 2 according to an exemplary embodiment of the present invention. Referring to FIG. 11, the controller 140 may be an analog control circuit that controls an average voltage or an average current using only one of two parameters, that is, voltage and current, and may include an operational amplifier 144 and a comparator 145.

A non-inverting terminal of the operational amplifier 144 receives a dimming control signal DCS that is sent from an external device, for example, a user's remote controller, and determines a dimming range. The dimming control signal DCS is used as reference signal Vref for outputting a difference between the dimming control signal DCS and the detected current detection signal CDS of the AC voltage source 101. An inverting terminal of the operational amplifier 144 receives the voltage detection signal VDS of the AC voltage source 101 detected by the voltage detector 150 or the current detection signal CDS supplied to the AC LED 170 detected by the current detector 160, which first passes through a resistor Z1.

The operational amplifier 144 outputs a difference between two values input to two input terminals of the operational amplifier 144. Thus, the operational amplifier 144 outputs the difference between the dimming control signal DCS and the voltage detection signal VDS or the current detection signal CDS using the dimming control signal DCS as the reference signal Vref.

The comparator 145 receives the output from the operational amplifier 144 through an inverting terminal of the comparator and a triangular wave (lamp waveform) through a non-inverting terminal thereof. The triangular wave may be set to a suitable period and magnitude in order to control a pulse width modulation duty ratio corresponding to the output from the operational amplifier 144. Accordingly, the comparator 145 outputs, based on the triangular wave (lamp waveform), a pulse width modulation signal having a pulse width modulation duty ratio adjusted according to the output of the operational amplifier 144.

The LED according to the exemplary embodiments described herein is illustrated as an example of an AC light emitting device directly using an AC voltage source. However, the present invention is not limited thereto and may also be applied to various other light emitting devices, such as an AC laser diode (LD), which emits light directly using the AC voltage source, through suitable modification.

In addition, the present invention may be variously modified for an average voltage control technique, which detects an AC voltage of the AC voltage source to supply a constant voltage to a lamp directly using the AC voltage source.

In addition, the present invention may be variously modified for an average current control technique, which detects the AC voltage of the AC voltage source to supply a constant current to the lamp directly using the AC voltage source.

In addition, the present invention may be variously modified for a single phase bridge switch, which permits chopper control of the AC voltage through pulse width modulation to drive the lamp directly using the AC voltage source.

Further, the present invention may be variously modified for a voltage detector for detecting the AC voltage of the AC voltage source applied as a control parameter of a control circuit for the purpose of constant voltage control or protection of the lamp directly using the AC voltage source.

Further, the present invention may be variously modified for a current detector of an AC chopper applied as a control parameter of the control circuit for the purpose of constant current control or protection of the lamp directly using the AC voltage source.

Furthermore, the present invention may be variously modified for digital control though pulse width modification using a programmable microcontroller.

Figure 12:
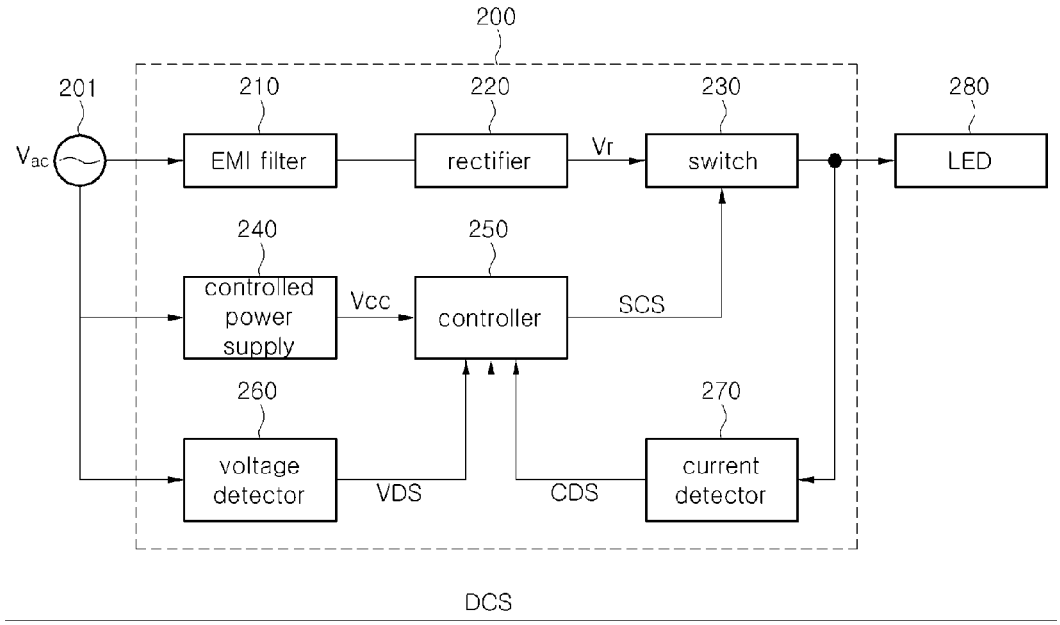
FIG. 12 is a block diagram of an LED dimmer according to an exemplary embodiment of the present invention.

FIG. 12 is a block diagram of an LED dimmer according to an exemplary is embodiment of the present invention.

Referring to FIG. 12, an LED dimmer 200 includes an electromagnetic interference (EMI) filter 210, a rectifier 220, a switch 230, a controlled power supply 240, a controller 250, a voltage detector 260, and a current detector 270. The EMI filter 210 eliminates electromagnetic interference included in an AC voltage Vac of an AC voltage source 201 to allow the AC voltage Vac having no electromagnetic interference to be output to the rectifier 220. That is, the EMI filter 210 eliminates impulse noise, harmonics or the like due to electromagnetic interference inside or outside the LED dimmer 200, which is produced in a power line between the AC voltage source 201 and an LED 280. The EMI filter 210 is optional, but is preferably included in the dimmer 200 to reduce the electromagnetic interference while improving a power factor.

The rectifier 220 receives the AC voltage of the AC voltage source 201 output from the EMI filter 210 and full-wave rectifies the AC voltage Vac to output a rectified voltage Vr. The switch 220 is turned on/off in response to a switching control signal SCS output from the controller 250 and selectively delivers the rectified voltage Vr to the LED 280. In this exemplary embodiment, the LED 280 may be a single LED or a light emitting module comprising LEDs capable of operating through full-wave rectification of the AC voltage Vac.

The controlled power supply 240 performs rectification and voltage conversion functions. The controlled power supply 240 receives an AC voltage Vac from the AC voltage source 201 and outputs a controlled voltage Vcc through full-wave rectification of the AC voltage into a DC voltage and voltage drop of the DC voltage. Herein, the AC voltage Vac is illustrated as being directly input from the AC voltage source 201 to the controlled power supply 240, but the present invention is not limited to this configuration and may be configured to allow the AC voltage Vac to be input to the controlled power supply 240 through the EMI filter 210 to remove electromagnetic interference from the AC voltage Vac of the AC voltage source 201.

The controller 250 outputs a switching control signal SCS in response to a dimming control signal DCS for controlling a dimming function for the LED 280 from an external device, a voltage detection signal VDS from the voltage detector 260, and a current detection signal CDS from the current detector 270.

The switching control signal SCS output from the controller 250 has a duty ratio corresponding to a difference between the dimming control signal DCS and each of the voltage detection signal VDS and the current detection signal CDS. Specifically, when the difference between the voltage detection signal VDS and the dimming control signal DCS has a positive value (+), the controller 250 primarily reduces a pulse width of the switching control signal SCS by the corresponding difference, and secondarily controls the pulse width of the switching control signal SCS according to the current detection signal CDS. On the other hand, when the difference between the voltage detection signal VDS and the dimming control signal DCS has a negative value (−), the controller 250 primarily increases the pulse width of the switching control signal SCS by the corresponding difference, and secondarily controls the pulse width of the switching control signal SCS according to the current detection signal CDS.

According to the present invention, the controller 250 is not limited to this configuration and may generate a switching control signal SCS corresponding to a difference between one of the voltage detection signal VDS and the current detection signal CDS and the dimming control signal DCS. In other words, the controller 250 detects the voltage detection signal VDS and the current detection signal CDS to control a dimming level of the LED 280 corresponding to the dimming control signal DCS. For this purpose, the controller 250 may include a proportional integral (PI) analog control circuit. The controller 250 may be, for example, a programmable 8-bit microcontroller, which may allow interconnection to an external device (for example, a remote controller or home network system) while extending the operating range of the dimming system.

Further, the controller 250 receives a ramp signal to generate a switching control signal (SCS) having at least one pulse. The switching control signal (SCS) may be a square wave having a frequency of 20-100 kHz or more, and the pulse width modulation may be controlled in a wide range of 1-100%. The switching control signal (SCS) may be varied in level depending on the magnitude of voltage, at which a transistor constituting the switch 230 can be turned on, and on the magnitude of voltage between a gate terminal and a source terminal, at which a transistor constituting the switch 230 can be turned off. A variable resistor may be used to control the duty ratio of the switching control signal SCS. The variable resistor may be directly or indirectly coupled to a manipulator (not shown) for dimming the LED 280 to be adjusted by the manipulator as needed, thereby enabling the dimming function for the LED 280 to be performed. The controller 250 will be described in more detail with reference to FIGS. 19 and 21.

The voltage detector 260 detects the voltage Vac of the AC voltage source 201 to output the voltage detection signal VDS. The voltage detection signal VDS is used to determine voltage fluctuation of the AC voltage source 201. Herein, the AC voltage Vac is illustrated as being directly input from the AC voltage source 201 to the voltage detector 260, but the present invention is not limited to this configuration and may be configured to allow the AC voltage Vac to be input to the voltage detector 260 through the EMI filter 210 to remove electromagnetic interference from the AC voltage Vac of the AC voltage source 201. The current detector 270 detects electric current in the LED 280 to output the current detection signal CDS. The current detector 270 may be, for example, a resistor or a current sensor connected to the switch 230 to detect electric current flowing from the switch 230 to the LED 280.

Figure 13:
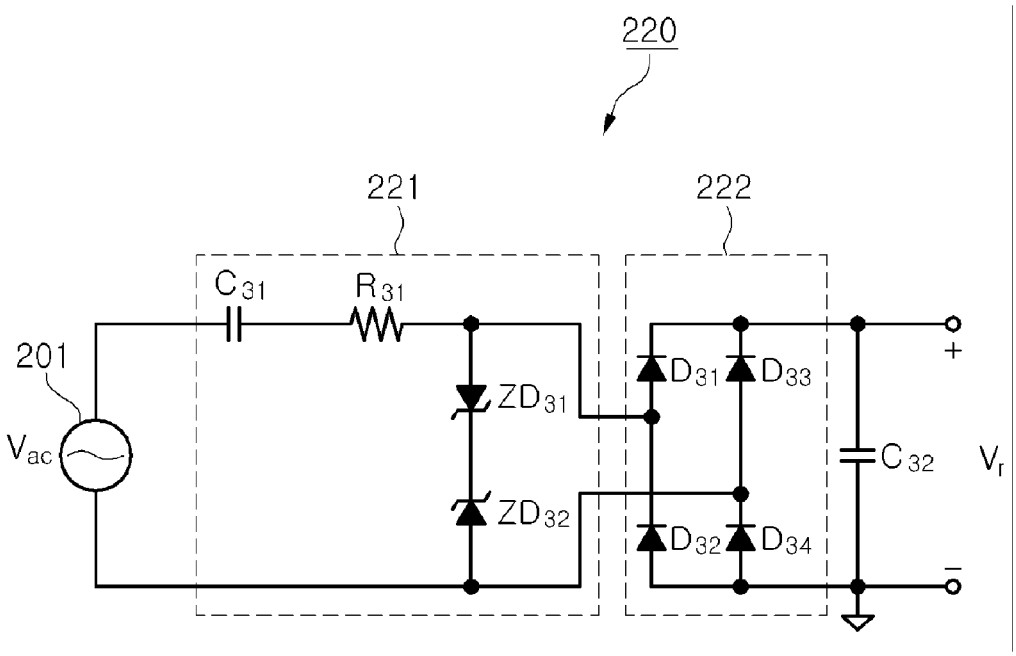
FIG. 13 is an exemplary circuit diagram of a rectifier of the LED dimmer according to an exemplary embodiment of the present invention.

FIG. 13 is a circuit diagram of the rectifier 220 shown in FIG. 12.

Referring to FIG. 13, the rectifier 220 includes a voltage divider 221 to divide a voltage Vac of the AC voltage source 201, a first full-wave rectifying unit 222 to full-wave rectify the voltage divided by the voltage divider 221, and a first voltage stabilizer $C_{32}$ to stabilize the voltage full-wave rectified by the first full-wave rectifying unit 222.

The voltage divider 221 includes a capacitor $C_{31}$ connected in series to the AC voltage source 201 (Vac), a resistor $R_{31}$ connected in series to the capacitor $C_{31}$, and a pair of Zener diodes $ZD_{31}$ and $ZD_{32}$ connected in series to the resistor $R_{31}$. A predetermined Zener voltage $V_{ZD}$ across the Zener diodes $ZD_{31}$ and $ZD_{32}$ is connected in parallel to an input terminal of the first full-wave rectifying unit 222.

The pair of Zener diodes $ZD_{31}$ and $ZD_{32}$ are connected in inverse series to provide predetermined Zener voltages $V_{ZD}$ and $-V_{ZD}$ under the AC voltage source 201 (Vac).

Operation of the rectifier 220 will now be described in detail. Since the capacitor $C_{31}$, resistor $R_{31}$, and pair of Zener diodes $ZD_{31}$ and $ZD_{32}$ connected in series to one another are connected to the AC voltage source 201 through the EMI filter 210, and the pair of Zener diodes $ZD_{31}$ and $ZD_{32}$ are connected to the input terminal of the first full-wave rectifying unit 222, the pair of Zener diodes $ZD_{31}$ and $ZD_{32}$ act to limit an input voltage of the first full-wave rectifying unit 222 to a predetermined Zener voltage $V_{ZD}$.

The voltage across the capacitor $C_{31}$ may vary depending on power consumption of the capacitor $C_{32}$ of the first voltage stabilizer. In this case, for the capacitor $C_{31}$, resistor $R_{31}$ and pair of Zener diodes $ZD_{31}$ and $ZD_{32}$ connected in series to one other, the voltage Vac of the AC voltage source 201 is divided in a predetermined proportion, and an AC input voltage of the first full-wave rectifying unit 222 including diodes $D_{31}$, $D_{32}$, $D_{33}$, and $D_{34}$ varies depending on the power consumption of the capacitor $C_{32}$.

Hence, the capacitance of the capacitor $C_{31}$ may be designed in consideration of the power consumption of the capacitor $C_{32}$. For example, the capacitor $C_{31}$ may have a capacitance of 100~330 nF.

Further, the use of the pair of Zener diodes $ZD_{31}$ and $ZD_{32}$ may be optional according to whether the capacitor $C_{31}$ may be optimally designed in consideration of the power consumption of the capacitor $C_{32}$.

The capacitor $C_{32}$ forms a first voltage stabilizer. The first voltage stabilizer stabilizes the voltage rectified by the first full-wave rectifying unit 222 into DC voltage and provides the stabilized voltage to the switch 230.

Figure 14:
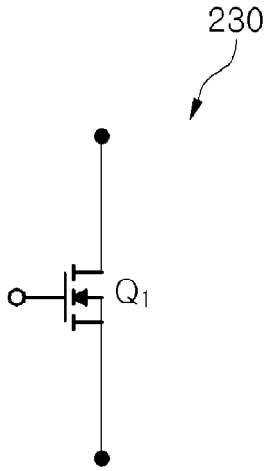
FIG. 14 is an exemplary circuit diagram of a switch of the LED dimmer according to an exemplary embodiment of the present invention.

FIG. 14 shows one example of the switch 230 shown in FIG. 12. Referring to FIG. 14, the switch 230 may include a transistor $Q_1$. The transistor $Q_1$ of the switch 230 is turned on/off in response to a switching control signal SCS, that is, a pulse width modulation signal, from the controller 250.

Since an on/off period of the switch 230 is included within the cycle of the pulse width modulation signal according to a duty ratio of the pulse width modulation signal, the input voltage and current of the LED 280 is changed according to the pulse width modulation signal. Hence, an internal cycle in a period during which the input voltage of the LED 280 is changed according to the pulse width modulation signal and an internal cycle in a period during which the input current appears may be the same as the cycle of the pulse width modulation signal.

Herein, an N-type MOSFET is illustrated as the transistor Q1. However, the present invention is not limited thereto, and the transistor Q1 may be a P-type MOSFET. In addition, any type of transistor may be employed so long as it can be rapidly switched by the pulse width modulation signal to apply the voltage Vr, which is full-wave rectified by the rectifier 220, to the LED 280.

Figure 15:
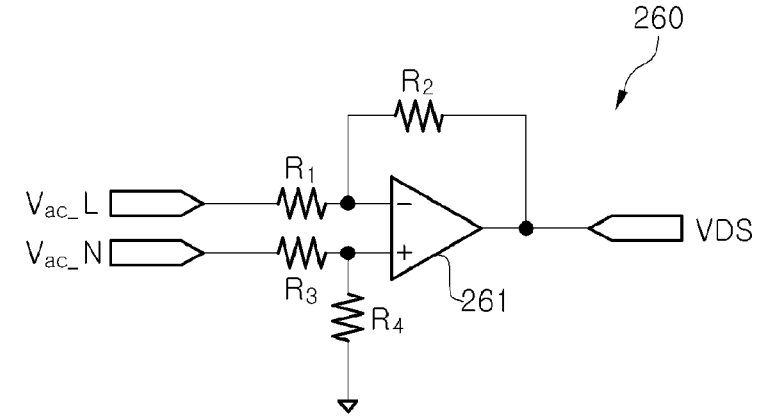
FIG. 15 is an exemplary circuit diagram of a voltage detector of the LED dimmer according to an exemplary embodiment of the present invention.
Figure 16:
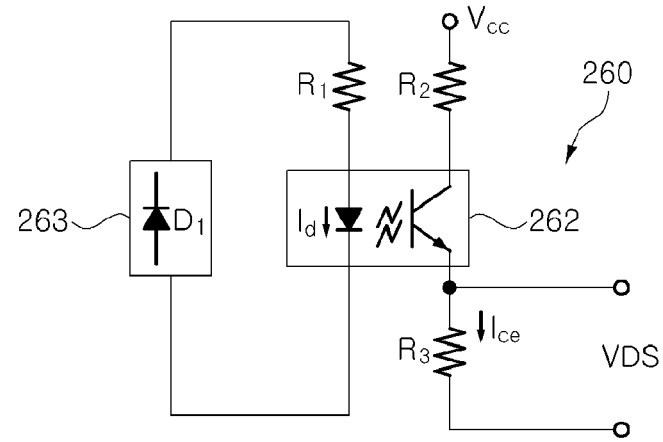
FIG. 16 is an exemplary circuit diagram of the voltage detector of the LED dimmer according to an exemplary embodiment of the present invention.

FIGS. 15 and 16 are circuit diagrams of the voltage detector 260 shown in FIG. 12 according to exemplary embodiments of the present invention.

Referring to FIG. 15, the voltage detector 260 may be a differential amplification circuit that includes an operational amplifier 261 for detecting AC voltage.

A first terminal Vac_L of the AC voltage source 201 is connected to an inverting terminal (−) of the operational amplifier 261 through a resistor R1, and a second terminal Vac_N of the AC voltage source 201 is connected to a non-inverting terminal (+) of the operational amplifier 261 through a resistor R3. Here, a gain of an output voltage is determined by a resistance ratio of a circuit constituted by the resistors R1 and R2, and a resistance ratio of a circuit constituted by resistors R3 and R4. The resistance ratio of the resistors R1 and R2 should be the same as that of the resistors R3 and R4. Additionally, the resistors R1 and R3 should have higher resistance than the resistors R2 and R4.

For example, when an AC voltage Vac of 220V is used, a difference of 220V is maintained between an L-phase voltage input through the first terminal Vac_L of the AC voltage source 201 and an N-phase voltage input through the second terminal Vac_N of the AC voltage source 201. In this case, since the operational amplifier 261 adjusts the gain of the output voltage according to the resistance ratio of the resistors R1 and R2 and the resistance ratio of the resistors R3 and R4, for example, a voltage detection signal VDS of 1V may be output from the operational amplifier 261.

In a circuit set to normally operate at an AC voltage Vac of 220V, input of an AC voltage of 210V or 230V resulting from variation in the AC voltage source 201 causes the operational amplifier 261 to output a different signal from the voltage detection signal VDS of 1V. Accordingly, the voltage detection signal VDS is used to determine variation in voltage of the AC voltage source 201.

The voltage detector 260 supplies the voltage detection signal VDS to the controller 250, when the voltage detection signal VDS is output from the operational amplifier 261. The controller 250 generates a switching control signal for controlling the switch 230 based on the voltage detection signal VDS supplied from the voltage detector 260.

FIG. 16 is a circuit diagram of the voltage detector of the AC LED dimmer according to an exemplary embodiment.

Referring to FIG. 16, the voltage detector 260 shown in FIG. 16 may be embodied as a circuit, which includes a photo coupler 262 and a bridge rectifier (D 1) 263 and is capable of detecting a bidirectional AC voltage by converting the AC voltage into a single phase DC voltage. Here, the voltage detector 260 may detect the magnitude of AC voltage by being electrically insulated from the AC voltage source 201 through the photo coupler 262.

In operation of the voltage detector 260, the bridge rectifier (DI) 263 converts a bidirectional AC voltage into a single phase DC voltage to supply a current Id to a primary diode of the photo coupler 262 through a resistor R1. Then, when a signal proportional to the current Id is applied to a base of a secondary diode of the photo coupler 262, a current Ice proportional to the current Id is supplied to a collector and an emitter of the secondary diode of the photo coupler 262. Here, resistors R2 and R3 determine the magnitudes of the current Ice and the signal. The resistor R2 represents an inverted output with respect to an input and the resistor R3 represents a non-inverted output with respect to the input. Thus, when the current Ice flows through the resistor R3, the voltage applied to the resistor R3 is delivered to the controller 250 as the voltage detection signal VDS of the AC voltage source 201.

Figure 17:
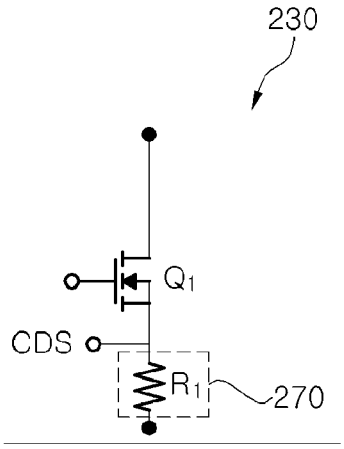
FIG. 17 is a circuit diagram illustrating detection of electric current output from the switch of the LED dimmer to an LED according to an exemplary embodiment of the present invention.
Figure 18:
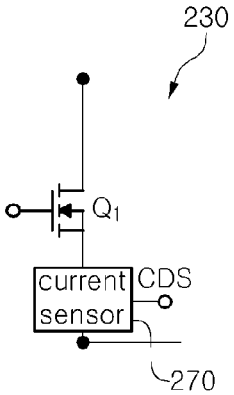
FIG. 18 is a circuit diagram illustrating detection of electric current flowing in the switch of the LED dimmer according to an exemplary embodiment of the present invention.

FIGS. 17 and 18 are circuit diagrams of the current detector 270 shown in FIG. 12 according to exemplary embodiments of the present invention. The current detector 270 is operated when connected to the circuit of the switch 230.

Referring to FIG. 17, the current detector 270 may be composed of a resistor R1 and connected to the circuit of the switch 230 shown in FIG. 14 to detect a current flowing in the switch 230. In other words, the current detector 270 may allow the current across the resistor R1 to be output as a current detection signal CDS by connecting one side of the resistor R1 constituting the current detector 270 to the source of the switching transistor $Q_1$ of the switch 230 shown in FIG. 14 while connecting the one side of the resistor $R_1$, which is connected to the source of the switching transistor $Q_1$, to the controller 250.

Referring to FIG. 18, the current detector 270 may be a current sensor connected to the circuit of the switch 230 shown in FIG. 14 to detect the current flowing to the LED 280 through the switch 230. A current sensor may include a current transformer or RF transformer. That is, the current detector 270 may detect the current output from the switch 230 to the LED 280 by connecting one side of the current sensor constituting the current detector 270 to the source of the switching transistor $Q_1$ of the switch 230 shown in FIG. 14. The current detected by the current sensor of the current detector 270 is supplied to the controller 250. The operation of the current detector according to the exemplary embodiment is the same as the exemplary embodiment shown in FIG. 17. The difference between the two exemplary embodiments of the current detector 270 is that the circuit shown in FIG. 18 may detect a relatively high current of several dozen amperes using the current sensor including the current transformer or RF transformer. In the circuit of the exemplary embodiment shown in FIG. 17, since the resistor $R_1$ used for current detection may cause power loss ($I_o^2$*R), it may be restrictively used in detection of a current of several amperes or more.

Figure 19:
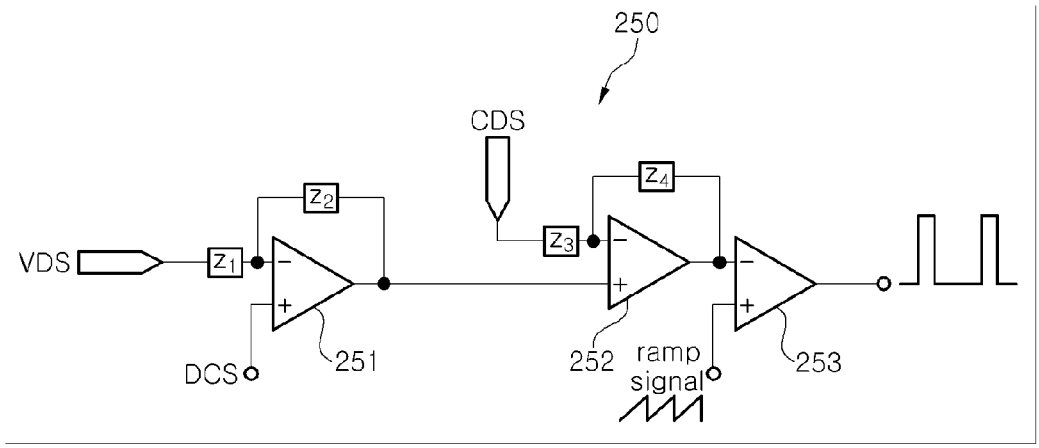
FIG. 19 is a circuit diagram of a controller of the LED dimmer according to an exemplary embodiment of the present invention.

FIG. 19 is a circuit diagram of the controller of the LED dimmer according to an exemplary embodiment of the present invention.

Referring to FIG. 19, the controller 250 may be an analog control circuit that controls both an average voltage and an average current using two parameters, that is, voltage and current, and may include a first operational amplifier 251, a second operational amplifier 252 and a comparator 253.

A non-inverting terminal of the first operational amplifier 251 receives a dimming control signal DCS that is sent from an external device, for example, a user's remote controller, and determines a dimming range. The dimming control signal DCS is used as reference signal Vref for outputting a difference between the dimming control signal DCS and the voltage detection signal VDS. An inverting terminal of the first operational amplifier 251 receives the voltage detection signal VDS detected by the voltage detector 260.

The first operational amplifier 251 outputs a difference between two values input to two input terminals of the first operational amplifier 251. Accordingly, the first operational amplifier 251 outputs the difference between the dimming control signal DCS sent from the external device and the voltage detection signal VDS detected by the voltage detector 260 using the dimming control signal DCS as a reference signal.

A non-inverting terminal of the second operational amplifier 252 receives an output from the first operational amplifier 251. An inverting terminal of the second operational amplifier 252 receives the current detection signal CDS detected by the current detector 270. Then, the second operational amplifier 252 outputs a difference between two values input to two input terminals of the second operational amplifier 252. Accordingly, the second operational amplifier 252 outputs the difference between the current detection signal CDS detected by the current detector 270 and the output from the first operational amplifier 251, which reflects the difference between the voltage detection signal VDS detected by the voltage detector 260 and the dimming control signal DCS sent from the remote controller.

The comparator 253 receives the output from the second operational amplifier 252 through an inverting terminal of the comparator 253 and a triangular wave (ramp signal) through a non-inverting terminal thereof. The triangular wave may be set to a suitable period and magnitude in order to control a pulse width modulation duty ratio corresponding to the output from the second operational amplifier 252. Accordingly, the comparator 253 outputs, based on the triangular wave (ramp signal), a pulse width modulation signal having a pulse width modulation duty ratio adjusted according to the output of the second operational amplifier 252.

As such, the controller 250 of FIG. 19 may be configured to output a first difference between the voltage detection signal VDS and the dimming control signal DCS, to output again a second difference between the current detection signal CDS and the first difference, and to generate and output, as a switching control signal SCS, a pulse width modulation signal having a pulse width modulation duty ratio adjusted according to the second difference. Hence, the current parameter is significant in relation to a control operation of the controller 250, so that the controller 250 may allow a more rapid and constant average current to be supplied to the LED 280. The first operational amplifier 251, second operational amplifier 252 and comparator 253 constituting the controller 250 may provide a proportional integral (PI) control analog circuit.

Next, operation of the LED dimmer of an exemplary embodiment will be described.

As shown in FIGS. 12 and 19, the controller 250 inputs a pulse width modulation signal to the gate of the switching transistor $Q_1$ of the switch 230 shown in FIG. 14 after generating the pulse width modulation signal based on signals VDS, CDS detected by the voltage detector 260, and current detector 270 using a dimming control signal DCS as reference signal Vref input from an external device, to control a dimming function for the LED 280.

Thus, when the gate of the switching transistor $Q_1$ in the switch 230 is turned on, electric current flows from the drain of the switching transistor $Q_1$ to the source of the switching transistor $Q_1$, so that current is supplied to the LED 280, which may thereby emit light.

On the other hand, when the gate of the switching transistor $Q_1$ in the switch 230 is turned off, current cannot flow from the drain of the switching transistor $Q_1$ to the source of the switching transistor $Q_1$, so that current is not supplied to the LED 280. Thus, the LED 280 does not emit light.

Since an optical output of the LED 280 depends on the product of voltage and current, the peak value increases as the duty ratio of the pulse width modulation signal increases, so that the optical output of the LED 280 also increases as the duty ratio of the pulse width modulation signal increases.

The pulse width modulation signal may be linearly controlled by adjusting the duty ratio in a predetermined range, for example, from 1% to 100%.

The duty ratio may be adjusted by the dimming control signal sent from an external device, for example, a remote controller. The dimming control signal may be used as the reference signal Vref for adjusting the duty ratio.

Figure 20:
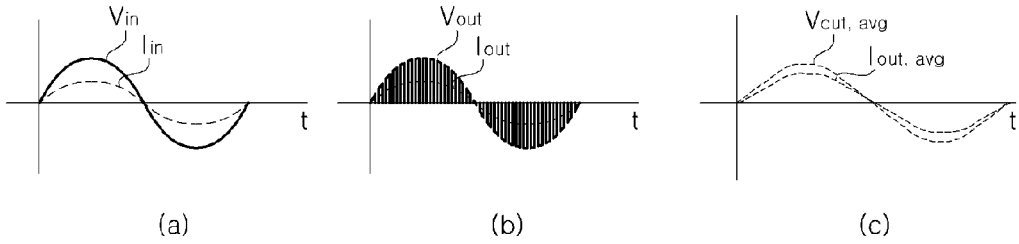
FIG. 20 is a waveform graph of input and output voltage and current in the LED dimmer according to an exemplary embodiment of the present invention.

FIG. 20 is a waveform graph of input and output voltage and current in the LED dimmer according to an exemplary embodiment of the present invention.

Referring to FIG. 20, (a) shows a waveform of AC input voltage and current, (b) shows a waveform of voltage and current supplied to the LED 280, and (c) shows a waveform of average voltage and current applied to the LED 280, which are realized by the pulse width modulation in the LED dimmer of the exemplary embodiment.

As shown in FIG. 20, the period of current in (c) showing the waveform of the average voltage and current of the LED 280 is the same as a light emitting period of the LED 280.

Figure 21:
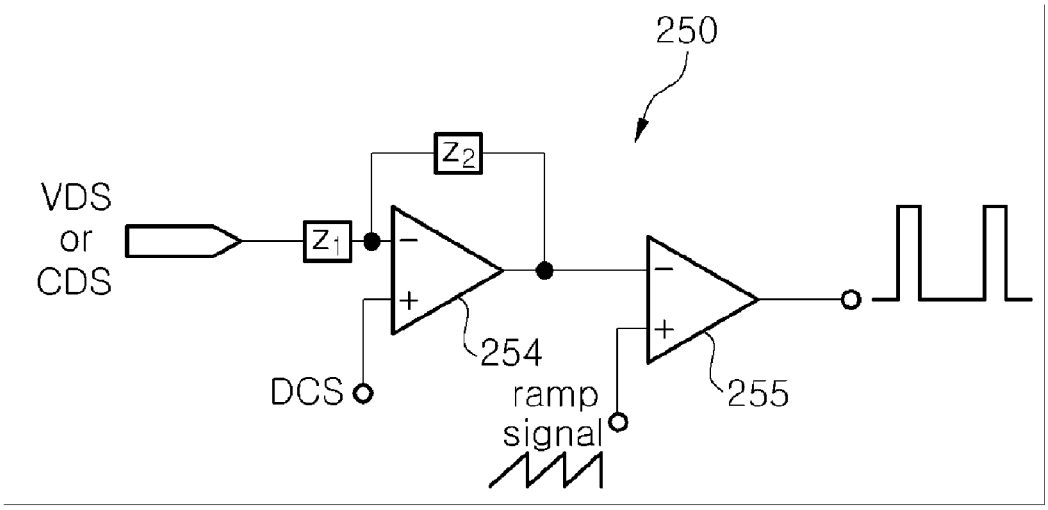
FIG. 21 is a circuit diagram of the controller of the LED dimmer according to an exemplary embodiment of the present invention.

FIG. 21 is a circuit diagram of the controller shown in FIG. 12 according to an exemplary embodiment of the present invention. Referring to FIG. 21, the controller 250 may be an analog control circuit that controls an average voltage or an average current using only one of two parameters, that is, voltage and current, and may include an operational amplifier 254 and a comparator 255.

A non-inverting terminal of the operational amplifier 254 receives a dimming control signal DCS that is sent from an external device, for example, a user's remote controller, and determines a dimming range. The dimming control signal DCS is used as reference signal Vref for outputting a difference between the dimming control signal DCS and the detected current detection signal CDS of the AC voltage source 201. An inverting terminal of the operational amplifier 254 receives the voltage detection signal VDS of the AC voltage source 201 detected by the voltage detector 260 or the current detection signal CDS supplied to the LED 280 detected by the current detector 260, which first passes through a resistor Z1.

The operational amplifier 254 outputs a difference between two values input to two input terminals of the operational amplifier 254. Thus, the operational amplifier 254 outputs the difference between the dimming control signal DCS and the voltage detection signal VDS or the current detection signal CDS using the dimming control signal DCS as the reference signal Vref.

The comparator 255 receives the output from the operational amplifier 254 through a non-inverting terminal of the comparator and a triangular wave (ramp signal) through an inverting terminal thereof. The triangular wave may be set to a suitable period and magnitude in order to control a pulse width modulation duty ratio corresponding to the output from the operational amplifier 254. Accordingly, the comparator 255 outputs, based on the triangular wave (ramp signal), a pulse width modulation signal having a pulse width modulation duty ratio adjusted according to the output of the operational amplifier 254.

The LED according to the exemplary embodiments described herein is illustrated as an example of a light emitting device using an AC voltage source. However, the invention is not limited thereto and may also be applied to various other light emitting devices, such as a DC laser diode (LD), which emit light directly using the AC voltage source, through suitable modification.

In addition, the present invention may be variously modified for an average voltage control technique, which detects an AC voltage of the AC voltage source to supply a constant voltage to a lamp using the AC voltage source.

In addition, the present invention may be variously modified for an average current control technique, which detects the AC voltage of the AC voltage source to supply a constant current to the lamp using the AC voltage source.

Further, the present invention may be variously modified for a voltage detector for detecting the AC voltage of the AC voltage source applied as a control parameter of a control circuit for the purpose of constant voltage control or protection of the lamp using the AC voltage source.

Furthermore, the present invention may be variously modified for digital control though pulse width modification using a programmable microcontroller.

As such, according to exemplary embodiments of the present invention, the dimmer may overcome problems of the conventional dimmer that has a limited dimming range depending on the drive voltage of the Triac and the operating characteristics of the resistor and capacitor of the R/C phase controller.

In addition, the dimmer according to exemplary embodiments of the present invention may minimize generation of harmonics upon turn-on switching operation and flickering of the AC LED.

Further, the dimmer according to exemplary embodiments of the present invention may produce a pulse width modulation signal proportional to a dimming control signal by calculating more accurate magnitudes of AC voltage and current. Moreover, the dimmer according to exemplary embodiments may enable easier interconnection with an external digital device, such as a home network system or a remote controller, than an analog controller.

Conventionally, a timer of an analog circuit comprising a resistor and a capacitor can cause an erroneous output due to difference in capacitance of passive elements. On the contrary, according to exemplary embodiments, the dimmer may enable more accurate calculation of time using an inner timer of the dimmer through digital control with a microcontroller and may output a more accurate pulse width modulation signal than the analog controller.

In addition, the dimmer according to exemplary embodiments may be a low-capacity transformer when the AC LED increases in capacity.

According to exemplary embodiments, the dimmer may provide a more accurate switching control signal proportional to a dimming control signal from an external device for controlling a dimming function of a light emitting device by outputting the switching signal through pulse width modulation control in response to the dimming control signal, a voltage detection signal from the voltage detector, and a current detection signal from the current detector.

Although some embodiments have been provided for illustration of the invention, the invention is not limited to these exemplary embodiments. It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A dimmer for a light emitting device, comprising:

a switch to be switched in response to a switching control signal and to deliver an alternating current (AC) voltage of an AC voltage source to the light emitting device;

a current detector to detect an electric current to be provided to the light emitting device and to output a current detection signal;

a controller to output the switching control signal in response to a dimming control signal and the current detection signal; and a voltage detector to output a voltage detection signal, the voltage detection signal to determine a voltage variation of the AC voltage source.

2. The dimmer of claim 1, wherein a duty ratio of the switching control signal corresponds to a difference between the current detection signal and the dimming control signal.

3. The dimmer of claim 1, wherein the controller further receives a ramp signal, and the controller comprises a first operational amplifier comprising a non-inverting terminal to receive the dimming control signal and an inverting terminal to receive the current detection signal, and a comparator comprising an inverting terminal to receive an output of the first operational amplifier and a non-inverting terminal to receive the ramp signal.

4. The dimmer of claim 1, wherein a duty ratio of the switching control signal corresponds to a difference between the current detection signal and a first difference, wherein the first difference comprises the difference between the dimming control signal and the voltage detection signal.

5. The dimmer of claim 1, wherein the controller comprises:

a first operational amplifier comprising a non-inverting terminal to receive the dimming control signal and an inverting terminal to receive the voltage detection signal;

a second operational amplifier comprising a non-inverting terminal to receive an output of the first operational amplifier and an inverting terminal to receive the current detection signal; and a comparator comprising an inverting terminal to receive an output of the second operational amplifier and a non-inverting terminal to receive a ramp signal.

6. The dimmer of claim 1, wherein the current detector comprises a resistor connected to the switch, the current detector to output an electric current flowing through the resistor as the current detection signal.

7. The dimmer of claim 1, wherein the current detector comprises a current sensor connected to the switch.

8. A dimmer for a light emitting device, comprising:

a switch to be switched in response to a switching control signal and to deliver an alternating current (AC) voltage of an AC voltage source to the light emitting device;

a current detector to detect an electric current to be provided to the light emitting device and to output a current detection signal; and a controller to output the switching control signal in response to a dimming control signal and the current detection signal;

wherein the switch comprises:

a switching transistor to be turned on or off in response to the switching control signal and to switch the AC voltage source supplied to the light emitting device;

an overvoltage protection diode connected to the switching transistor; and a plurality of power diodes comprising a bridge circuit to supply a forward current to the switching transistor.

9. The dimmer of claim 1, further comprising an electromagnetic interference filter coupled between the switch and the AC voltage source.

10. A dimmer for a light emitting device (LED), comprising:

a rectifier to receive an alternating current (AC) voltage from an AC voltage source and to output a rectified voltage through full-wave rectification of the AC voltage;

a switch to be switched in response to a switching control signal and to deliver the rectified voltage to the LED, a current detector to detect an electric current to be provided to the LED and to output a current detection signal; and a controller to output the switching control signal in response to a dimming control signal and the current detection signal; and a voltage detector to output a voltage detection signal, the voltage detection signal to determine a voltage variation of the AC voltage source.

11. The dimmer of claim 10, wherein a duty ratio of the switching control signal corresponds to a difference between the current detection signal and the dimming control signal.

12. The dimmer of claim 10, wherein the controller comprises:

a first operational amplifier comprising a non-inverting terminal to receive the dimming control signal and an inverting terminal to receive the current detection signal; and a comparator comprising an inverting terminal to receive an output of the first operational amplifier and a non-inverting terminal to receive a ramp signal.

13. The dimmer of claim 10, wherein a duty ratio of the switching control signal corresponds to a difference between the current detection signal and a first difference, wherein the first difference comprises the difference between the dimming control signal and the voltage detection signal.

14. The dimmer of claim 10, wherein the controller comprises:

a first operational amplifier comprising a non-inverting terminal to receive the dimming control signal and an inverting terminal to receive the voltage detection signal;

a second operational amplifier comprising a non-inverting terminal to receive an output of the first operational amplifier and an inverting terminal to receive the current detection signal; and a comparator comprising an inverting terminal to receive an output of the second operational amplifier and a non-inverting terminal to receive a ramp signal.

15. The dimmer of claim 10, wherein the current detector comprises a resistor connected to the switch, the current detector to output an electric current flowing through the resistor as the current detection signal.

16. The dimmer of claim 10, wherein the current detector comprises a current sensor connected to the switch.

17. The dimmer of claim 10, wherein the rectifier comprises a voltage divider to divide the voltage of the AC voltage source, a full-wave rectifier to rectify the divided voltage, and a voltage stabilizer to stabilize the voltage rectified by the full-wave rectifier.

18. The dimmer of claim 10, further comprising an electromagnetic interference filter coupled between the switch and the AC voltage source.

* * * * *